US006729298B1

(12) United States Patent
Sterr

(10) Patent No.: US 6,729,298 B1
(45) Date of Patent: May 4, 2004

(54) LINKAGE ASSEMBLY FOR VARIABLE ENGINE SPEED CONTROL

(75) Inventor: Randall E. Sterr, North Fond du Lac, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/377,428

(22) Filed: Feb. 28, 2003

Related U.S. Application Data

(60) Provisional application No. 60/421,100, filed on Oct. 24, 2002.

(51) Int. Cl.[7] ..... F02M 3/00

(52) U.S. Cl. ..... 123/339.13; 123/400

(58) Field of Search ..... 123/339.13, 400, 123/376, 319, 337, 395, 402, 403

(56) References Cited

U.S. PATENT DOCUMENTS

| | | | | | |
|---|---|---|---|---|---|
| 4,502,436 | A | | 3/1985 | Bonfiglioli et al. | 123/339 |
| 4,660,521 | A | | 4/1987 | Higuchi et al. | 123/376 |
| 4,773,371 | A | | 9/1988 | Stenz | 123/376 |
| 4,800,100 | A | * | 1/1989 | Herbots et al. | 427/527 |
| 4,860,608 | A | | 8/1989 | Kobayashi | 74/501.6 |
| 5,078,111 | A | | 1/1992 | McCann | 123/400 |
| 5,429,090 | A | | 7/1995 | Kotchi et al. | 123/396 |
| 6,311,672 | B1 | * | 11/2001 | Morishita et al. | 123/406.36 |
| 6,360,586 | B1 | * | 3/2002 | Morishita et al. | 73/35.08 |
| 6,611,145 | B2 | * | 8/2003 | Lodise et al. | 324/378 |
| 2002/0125586 | A1 | | 9/2002 | Clements et al. | 261/40 |

* cited by examiner

*Primary Examiner*—John Kwon
(74) *Attorney, Agent, or Firm*—Baker & Daniels

(57) ABSTRACT

A linkage assembly for a vehicle having a vehicle body and an engine mounted thereto. The linkage assembly is operably disposed between a user-operable speed control input mechanism, e.g., a foot-operated accelerator, and the engine. The linkage assembly includes first and second linkage bodies and sets the idle and maximum speed of the engine without restricting the range of movement of the input mechanism. The linkage assembly may also include two adjustable stop mechanisms for limiting the travel of one of the linkage bodies and thereby providing for the independent adjustment of the idle and maximum engine speeds.

23 Claims, 4 Drawing Sheets

LINKAGE ASSEMBLY FOR VARIABLE ENGINE SPEED CONTROL

CROSS REFERENCE TO RELATED APPLICATIONS

This application claims priority under 35 U.S.C. 119(e) of U.S. provisional patent application serial No. 60/421,100 filed on Oct. 24, 2002 entitled LINKAGE ASSEMBLY FOR VARIABLE ENGINE SPEED CONTROL the disclosure of which is hereby incorporated by reference.

BACKGROUND OF THE INVENTION

1. Field of the Invention

The present invention relates to engine speed controls and, more specifically, to a linkage assembly for an engine speed control.

2. Description of the Related Art

Small gasoline engines are often used with small recreational vehicles such as go-carts and mini-bikes. Such vehicles generally include a user-operated speed control mechanism such as a foot operated accelerator or a hand operated rotatable grip. Such vehicles are oftentimes operated at full throttle during nearly the entire time the vehicle is operated. For example, the operator of a go-cart may fully depress the foot accelerator during the entire time that the vehicle is being operated.

Such vehicles may also include a centrifugal clutch which engages when the engine reaches a predetermined engagement speed or rpm and disengages when the engine speed falls below the predetermined engagement speed. The idle speed of the engine must be below the predetermined engagement speed to allow the clutch to disengage when the vehicle is idling.

SUMMARY OF THE INVENTION

The present invention provides a linkage assembly which may be used with a vehicle for controlling the speed of the vehicle. The linkage assembly includes first linkage body and a second linkage body wherein the first linkage body is operably coupled to a user operable input mechanism and the second linkage body is operably coupled to the engine for controlling the speed thereof. The first and second linkage bodies are relatively moveable in a manner which allows the idle and maximum engine speeds defined by the linkage assembly to be set or adjusted without requiring an adjustment in the range of motion of the user operable input mechanism.

The invention comprises, in one form thereof, a vehicle having a vehicle body, an engine mounted on the vehicle body and a user-operable speed control assembly operably coupled to the engine wherein the speed control assembly selectively varies the speed of the engine. The speed control assembly includes a user-operable input mechanism having a first range of motion ranging from an input idle position to an input maximum position. A first linkage body is operably coupled with the input mechanism and has a second range of motion ranging from a first linkage idle position to a first linkage maximum position wherein movement of the input mechanism from the input idle position through the input maximum position correspondingly moves the first linkage body through the second range of motion from the first linkage idle position to the first linkage maximum position. A first biasing member is operably coupled to the speed control assembly for biasing the first linkage body and the user-operable input mechanism toward the first linkage idle position and the input idle position respectively. A second linkage body having a third range of motion which includes a second linkage idle position and a second linkage maximum throttle position is also provided. The second linkage body is operably coupled to the engine wherein movement of the second linkage body through the third range of motion varies the speed of the engine. Movement of the second linkage member in a first direction from the second linkage idle position toward the second linkage maximum throttle position progressively increases the speed of the engine. The second linkage body is movable relative to the first linkage body and a second biasing member biases the second linkage body relative to the first linkage body in the first direction. The second linkage body is engagable with the first linkage body whereby relative movement of the second linkage body relative to the first linkage body in the first direction is limited and wherein, as the first linkage body is moved through the second range of motion from the first linkage idle position to the first linkage maximum position, the second linkage body remains engaged with the first linkage body and is moved in the first direction until the second linkage member engages a stop which limits further travel of the second linkage member in the first direction. The first linkage body being intermediate the first linkage idle and the first linkage maximum positions when the second linkage body engages the stop. Further travel of the first linkage body toward the first linkage maximum position after the second linkage body has engaged the stop causing relative movement of the first and second linkage bodies in a direction opposed by the second biasing element.

In an alternative embodiment, the vehicle may also include a first adjustable stop mechanism operably disposed between the first linkage body and the second linkage body wherein the first stop mechanism selectively adjusts the relative positions of the first and second linkage bodies when the second linkage body is engaged with the first linkage body. The vehicle may also include a second adjustable stop mechanism operably disposed between the second linkage body and the vehicle body wherein the second stop mechanism includes the stop and selectively adjusts the extent to which the second linkage body can travel in the first direction. The first and second linkage bodies may be pivotally mounted about a common pivot axis. Additionally, the first biasing member may secured at one end to the first linkage body.

The invention comprises, in another form thereof, a vehicle having a vehicle body and an engine mounted on the vehicle body. The engine includes a governor lever coupled thereto wherein movement of the governor lever adjusts the speed of the engine. The vehicle includes a user-operated input mechanism having a first range of motion ranging from an input idle position to an input maximum position. A first linkage body is operably coupled to the input mechanism and has a second range of motion ranging from a first linkage idle position to a first linkage maximum position. A first biasing member is operably coupled to the first linkage body and biases the first linkage body toward the first linkage idle position. A second linkage body moveable through a third range of motion including a first position and a second position is operably coupled to the governor lever. Movement of the second linkage body in a first direction from the first position to the second position progressively moves the governor lever in a direction causing an increase in the speed of the engine. The second linkage body is movable relative to and engageable with the first linkage body and a second biasing member biases the second linkage body relative to said first linkage body in the first direction and toward engagement with the first linkage body. A first adjustable stop mechanism selectively adjusts the relative positions of the first and second linkage bodies when the second biasing member biases the first and second linkage bodies into engagement. The first and second linkage bodies are engagable when the first linkage body is in the first linkage idle position. A second adjustable stop mechanism is provided wherein movement of the first linkage mechanism from the first linkage idle position toward the first linkage maximum position engages the second linkage body with at least a portion of the second stop mechanism. The second stop mechanism selectively adjusts the relative positions of the second linkage body and the governor lever when the second linkage body engages said portion of the second stop mechanism. The first linkage, member is movable relative to the second linkage member to the first linkage maximum position with the second linkage body remaining engaged with said portion of the second stop mechanism.

In alternative embodiments, at least one of the first and second stop mechanisms of such a vehicle may include a threadingly adjustable member. The first and second linkage bodies may also be pivotally mounted on a common pivot member. The operable coupling of the input mechanism and the first linkage body may include the use of a bowden cable secured to the first linkage body.

The invention comprises, in yet another form thereof, a linkage assembly for a vehicle having an engine and an operator-controlled speed control input mechanism. The linkage assembly includes a mounting member securable to the vehicle, a first linkage body and a second linkage body. The first linkage body is pivotally secured to the mounting member and is movable relative to the mounting member in a range of motion extending from an idle position to a maximum position wherein movement from the idle position toward the maximum position defines a first pivotal direction. The first linkage body is adapted for operable coupling with the user-controlled input mechanism wherein the user-controlled input mechanism controls movement of the first linkage body through its range of motion. A first biasing member is operably disposed between the first linkage body and the mounting member for biasing the first linkage body with respect to the mounting member in a second pivotal direction opposite the first direction. The second linkage body is pivotally secured to the mounting member with each of the first and second linkage bodies being pivotal about a common axis. The second linkage body is adapted for operable coupling with the engine wherein movement of the second linkage body selectively adjusts the speed of the engine with movement of the second linkage body in the first pivotal direction progressively increasing the speed of the engine. A second biasing member is operably disposed between the first and second linkage bodies. The second biasing member biases the second linkage body relative to the first linkage body in the first direction. A first adjustable stop mechanism is operably disposed between the first and second linkage bodies wherein movement of the second linkage body in the first direction relative to the first linkage body is limited by the first stop mechanism. The relative positions of the first and second linkage bodies when the first and second linkage bodies are engaged being selectively adjustable by the first stop mechanism. A second adjustable stop mechanism is operably disposed between the mounting member and the second linkage member wherein movement of the second linkage body in the first direction relative to the mounting member is limited by the second stop mechanism. The relative positions of the mounting member and the second linkage body when the second stop mechanism has limited travel of the second linkage body being selectively adjustable by the second stop mechanism. As the first linkage body moves from the idle position toward the maximum position, the second linkage body remains in the relative position defined by the first stop mechanism and is moved in the first direction until the second adjustable stop mechanism limits further travel of the second linkage member in the first direction. The first linkage body is intermediate the idle position and the maximum position when movement the second linkage body is limited by the second stop mechanism and further travel of the first linkage body toward the maximum position after the second stop mechanism has limited further movement of the second linkage body causes relative movement of the first and second linkage bodies in a direction opposed by the second biasing member.

In alternative embodiments, the first and second stop mechanisms of the linkage assembly may each include a threadingly adjustable member. The first and second linkage bodies may be secured to the mounting member with a common fastener wherein the fastener defines the common pivot axis, i.e., the pivot axis of both linkage bodies. The first stop mechanism may include a first bent tab on the first linkage body, a second bent tab on the second linkage body and a threaded member secured in an opening in one of the bent tabs and engageable with the other of the bent tabs. The second stop mechanism may include a first bent tab on the mounting member, a second bent tab on the second linkage body and a threaded member secured in an opening in one of the bent tabs and engageable with the other of the bent tabs. The first biasing member may be a tension spring secured to the mounting member and the first linkage body.

The invention comprises, in another form thereof, a method of variably controlling the running speed of an engine. A user-operable input mechanism that is moveable through a first range of motion between an input idle position and an input maximum position and a linkage assembly having a first linkage body and a second linkage body are provided. The method includes operably coupling the first linkage body to the input mechanism wherein the first linkage body is moved through a second range of motion from a first linkage idle position to a first linkage maximum position as the input mechanism is moved from the input idle position to the input maximum position. The second linkage body is operably coupled to the engine wherein the position of said second linkage body controls the running speed of the engine. The second linkage body is adjustably positioned in a second linkage idle position relative to the first linkage body when the first linkage body is disposed in the first linkage idle position wherein adjustment of the second linkage idle position adjusts the idle speed of the engine. The second linkage body is operably coupled to the first linkage body wherein the second linkage body is moved from the second linkage idle position to a second linkage maximum throttle position as the first linkage body is moved from the first linkage idle position toward the first linkage maximum position and wherein movement of the second linkage body from the second linkage idle position toward the second linkage maximum throttle position progressively increases the speed of the engine. The method also includes stopping movement of the second linkage body at a selectively adjustable position defining the second linkage maximum throttle position before the input mechanism has reached the input maximum position and wherein the input mechanism is moveable to the input maximum position after stopping movement of the second linkage body at the second linkage maximum throttle position.

The method may also include biasing the second linkage body toward the first linkage body in a direction toward the second linkage maximum throttle position. Additionally, the method may include biasing the input mechanism toward the input idle position. The first linkage body may be moveable to the first linkage maximum position after stopping movement of the second linkage body at the second linkage maximum throttle position.

The invention may comprise, in yet another form thereof, a method of variably controlling the running speed of an engine. A user-operable input mechanism moveable through a first range of motion between an input idle position and an input maximum position and a linkage assembly having a first linkage body and a second linkage body are provided. The method also includes operably coupling the first linkage body to the input mechanism wherein the first linkage body is moved through a second range of motion from a first linkage idle position to a first linkage maximum position as the input mechanism is moved from the input idle position to the input maximum position. The second linkage body is operably coupled to the engine wherein the position of the second linkage body controls the running speed of the engine. The method also includes operably coupling the second linkage body to the first linkage body including (a) disposing the second linkage body in a selectively adjustable position relative to the first linkage body when the first linkage body is disposed in the first linkage idle position; (b) maintaining the second linkage body in the selected position relative to the first linkage body and moving the second linkage body in a first direction progressively increasing the speed of the engine as the first linkage is moved from the first linkage idle position toward the first linkage maximum position; and (c) stopping movement of the second linkage body in the first direction at a selectively adjustable location wherein the first linkage body is moveable relative to the second linkage body and to the first linkage maximum position after stopping movement of the second linkage body.

Maintaining the second linkage body in the selected position relative to the first linkage body may include biasing the second linkage body toward the first linkage body in the first direction. The method may also include biasing the first linkage body toward the first linkage idle position.

The method may also include biasing the second linkage body toward the first linkage body in said first direction and biasing the input mechanism toward the input idle position.

An advantage of some of the embodiments of the present invention is that it provides a linkage assembly which may be used to set or adjust the idle speed and maximum speed of the engine without restricting the motion of the user-operable input mechanism, such as a foot operated accelerator, which allows the operator to control the speed of the vehicle. The idle speed and maximum speed of the engine may be set independently of each other. It also allows the input mechanism to have a consistent feel throughout the range of its motion, i.e., the force biasing the input mechanism toward its idle position is relatively consistent throughout the range of motion of the input mechanism.

Another advantage of the present invention is that it provides a linkage assembly that may be used with a variety of existing accelerators or similar user-operable input mechanisms without requiring the modification of the accelerators.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
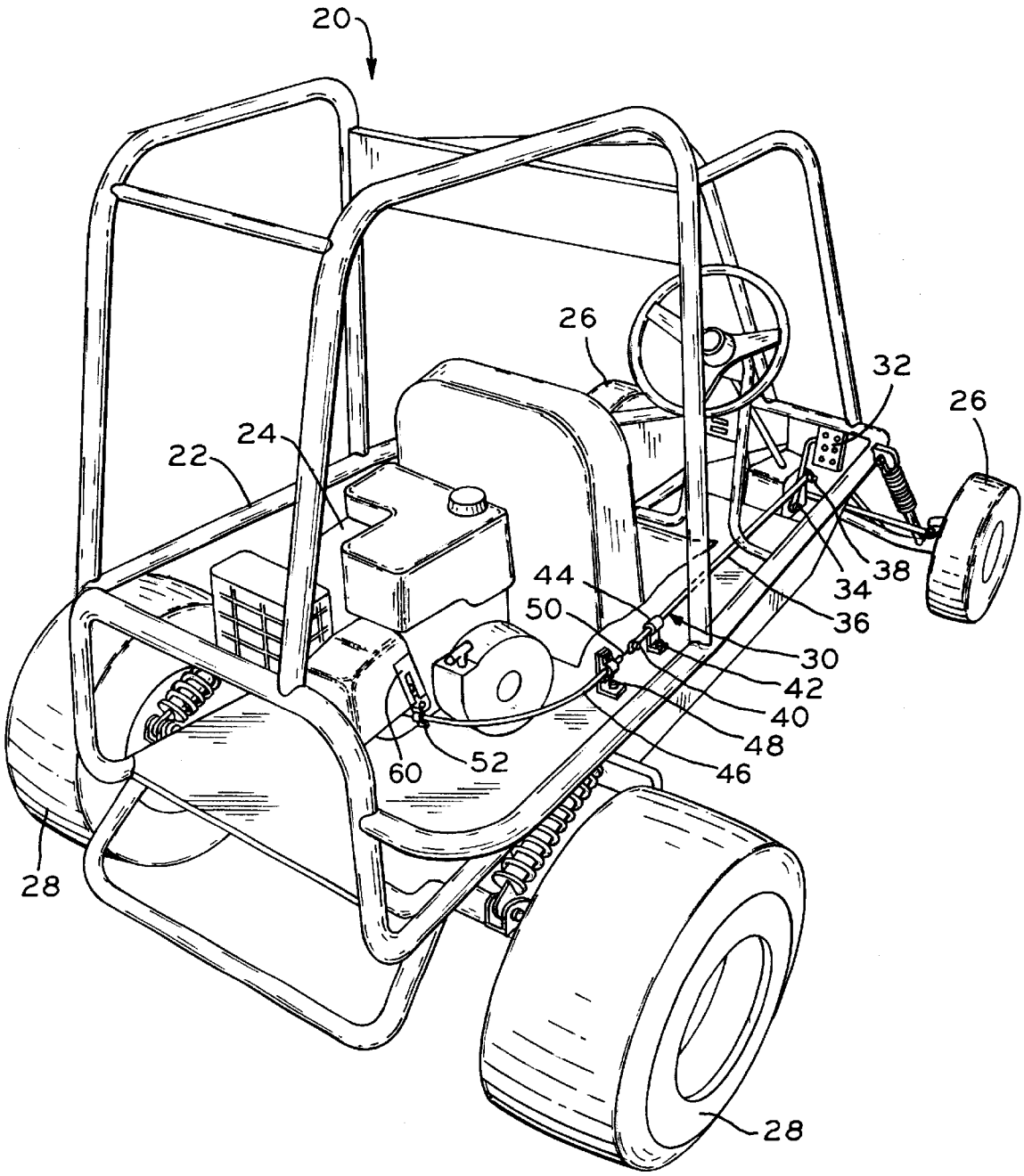
FIG. 1 is a partially cut-away perspective view of a vehicle in accordance with the present invention.

Corresponding reference characters indicate corresponding parts throughout the several views. Although the exemplification set out herein illustrates an embodiment of the invention, in one form, the embodiment disclosed below is not intended to be exhaustive or to be construed as limiting the scope of the invention to the precise form disclosed.

DESCRIPTION OF THE PRESENT INVENTION

In accordance with the present invention, FIG. 1 illustrates a vehicle 20 having a vehicle body 22 and an engine 24 mounted on vehicle body 22. The illustrated vehicle 20 is a go-cart but the present invention may also be used with other vehicles. Vehicle body 22 is a conventional go-cart body. Such vehicle bodies are well known in the art. Engine 24 is a conventional gasoline engine. In the illustrated embodiment, engine 24 is a Tecumseh Power Sport 6.0 horsepower engine commercially available from Tecumseh Products Company of Tecumseh, Mich.

Front wheels 26 are steerable while rear wheels 28 are driven by engine 24. A centrifugal clutch may be used with the vehicle 20. Such clutches are known to those having ordinary skill in the art and are automatically engaged when the engine reaches a predetermined engine speed and is disengaged when the engine speed falls below the predetermined speed. As discussed in greater detail below, the idle speed of engine 24 must be set below the predetermined speed at which the centrifugal clutch disengages for proper operation of vehicle 20.

Vehicle 20 also includes a user-operable speed control assembly 30. Assembly 30 includes a user-operable input mechanism which, in the illustrated embodiment, is a foot operated accelerator 32. Alternative operator controlled variable input mechanisms may also be used with the present invention. Accelerator 32 is pivotally mounted to vehicle body 22 with a bolt 34. A metal rod 36 has its front end 38 bolted to accelerator 32 and is moved forward toward front wheels 26 as accelerator 32 is pressed downwardly by the foot of the vehicle operator. The rear end 40 of rod 36 is attached to bowden cable 46. A bracket 42 is secured to vehicle body 22 and has an upper sleeve portion 44 which slidably supports rod 36. The outer sleeve of Bowden cable 46 is secured at one end to bracket 48 and inner metal cable 50 is secured to rod 36. A clamp 52 secures the outer sleeve of the opposite end of bowden cable 46.

Engine 24 of the illustrated embodiment includes a mechanical governor which is used to maintain engine 24 at a stable running speed. The use of such governors is well known in the art and one example of a mechanical governor that may be used with the present invention is disclosed in U.S. Pub. No. 2002/0125586 A1, assigned to the asssignee of the present invention, which is hereby expressly incorporated herein by reference.

A linkage assembly 60 is located between accelerator 32 and engine 24 and is best seen in FIGS. 2–7. Linkage assembly 60 includes a base plate 62 which is secured to engine 24 to mount assembly 60 thereto. A rivet 64 forms a pivot member and is used to pivotally mount a first linkage body 66 and a second linkage body 68 to base plate 62. Alternative fasteners or pivot members may also be used to pivotally mount first and second linkage bodies 66, 68. A tension spring 70 is secured at one end to a bent tab 72 located on baseplate 62 and is secured at its opposite end to a bent tab 74 forming the distal end of radially extending first arm 76 of first linkage body 66.

First linkage body 66 includes a second radially extending arm 78 which has a C-shaped tab 80 formed at its distal end. A torsion spring 82 is positioned between first linkage body 66 and second linkage body 68 and centered on rivet 64. One end of spring 82 is engaged by tab 80 and the opposite end of spring 82 extends through opening 84 in second linkage body 68 to thereby engage second linkage body 68.

A third radially extending arm 86 is provided on first linkage body 66 and has a C-shaped tab 88 with an arcuate cut-out for securely receiving retainer 90 located at the end of wire 50. First linkage body 66 also includes a fourth radially extending arm 92. Arm 92 extends downwardly through opening 94 in base plate 62 and includes a distal portion 96 which outwardly through opening 98 in side wall 100 (FIG. 6) of base plate 62. An opening 102 is located in distal portion 96 of fourth arm 92. Although in the illustrated embodiment first linkage body 66 is coupled with accelerator 32 by seating retainer 90 in C-shaped tab 88, alternative methods of coupling first linkage body 66 may also be used such as securing an appropriately positioned wire or rod to opening 102.

Also included on third arm 86 of first linkage body 66 is a bent tab 104 which extends toward second linkage body 68. Tab 104 includes a threaded opening in which threaded shaft 108 of bolt 106 is adjustably secured. A spring 110 is positioned on threaded shaft 108 to place shaft 108 in tension and thereby create a more secure engagement between bolt 106 and tab 104 (FIG. 5) and inhibit the unintentional rotation of bolt 106 due to the vibration of assembly 60 during operation of vehicle 20.

The second linkage body 68 includes a first radially extending arm 112. In addition to opening 84 which engages first arm 112 with torsion spring 82, another opening 114 is located in arm 112 near its distal end. A governor spring 116 has a substantially Z-shaped end which extends through opening 114 to thereby secure governor spring 116 to second linkage body 68. A stop 118 in the form of a bent tab projecting toward first linkage body 66 is located along one edge of arm 112 and is engageable with the distal end of threaded bolt 106. Stop 118, together with tab 104 and bolt 106 form a first adjustable stop mechanism 144. First and second linkage bodies 66 and 68 are engageable through stop mechanism 144. Stop mechanism 144 selectively adjusts the relative positions of the first and second linkage bodies when they are engaged by rotation of bolt 106 to thereby selectively adjust the idle speed of engine 24 as discussed in greater detail below. Alternative embodiments of stop mechanism 144 could involve threading bolt 106 through an opening in stop 118 or the use of other adjustably positionable engagement members.

Second linkage body 68 also includes a second radially projecting arm 120 which has near its distal end a tab 122 which projects toward base plate 62. A threaded opening is located in tab 122 and a threaded bolt 124 is adjustably secured within the opening in tab 122. Bolt 124 includes a threaded shaft 126 and a spring 128 is located on shaft 126. Similar to bolt 106 and spring 110, bolt 124 and spring 128 cooperate with tab 122 to place shaft 126 in tension and inhibit the unintentional rotation of bolt 124 due to vibration of assembly 60.

A stop 130 is formed in base plate 62 by bending a portion of base plate 62 to form a tab which projects parallel to rivet 64 and is engagable with the distal end of bolt 124 to limit the travel of second linkage body 68. Stop 130, together with tab 122 and bolt 124 form a second adjustable stop mechanism 146 which is operatively disposed between second linkage body 68 and vehicle body 22. Second stop mechanism 146 selectively adjusts the relative positions of the second linkage body and governor lever 138 when travel of second linkage body is stopped by the engagement of stop 130 and bolt 124 to thereby selectively adjust the maximum speed of engine 24 as discussed in greater detail below. Alternative embodiments of stop mechanism 146 could involve threading bolt 124 through an opening in stop 130 or the use of other adjustably positionable engagement members.

Also formed in base plate 62 are depressions 132 which include openings 34 therein. Bolts 135 are passed through openings 134 to mount base plate 62 to engine 24. An auxiliary bracket 136 is mounted to side wall 100 and clamp 52 is secured thereto.

Figure 7:
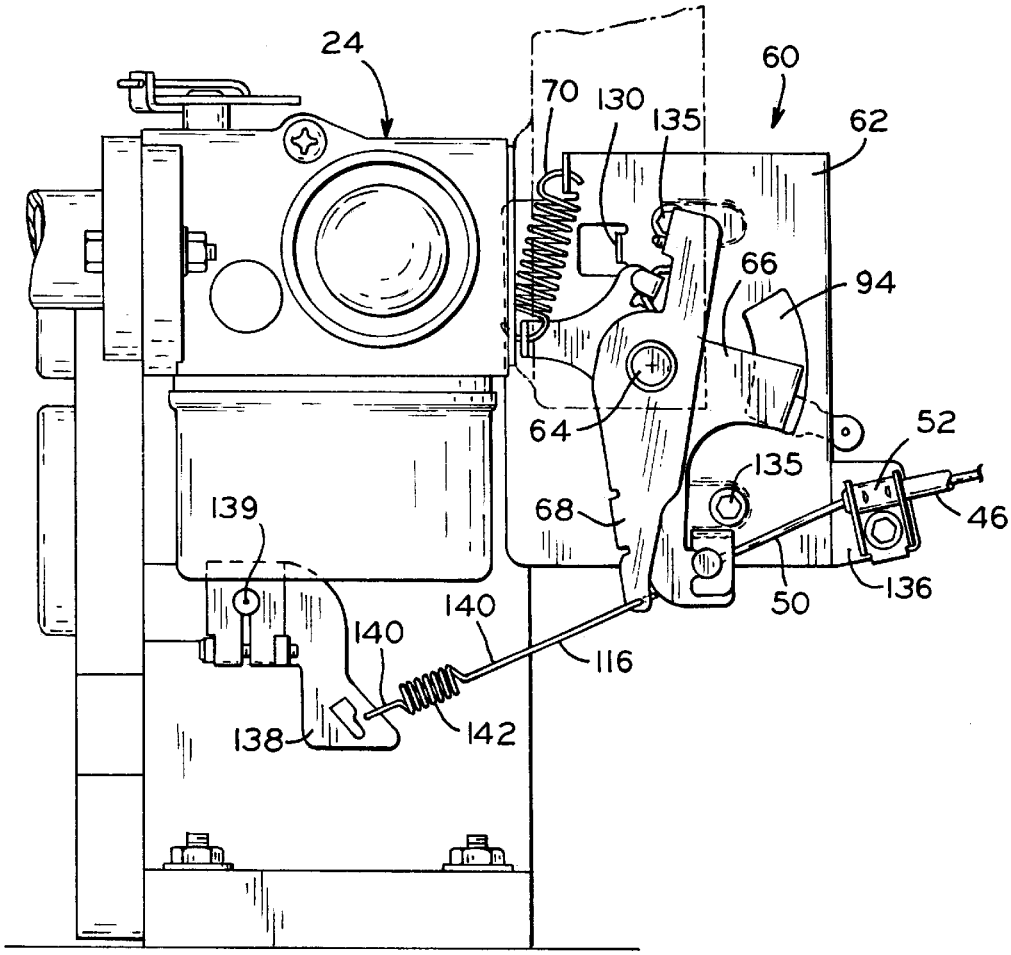
FIG. 7 is a partial rear view of the engine and linkage assembly of the vehicle of FIG. 1.

As best seen in FIG. 7, governor spring 116 connects second linkage body 68 with governor lever 138. Governor spring 116 includes stiff rod portions 140 and spring portion 142. Spring portion 142 is sufficiently stiff that displacement of second linkage body 68 will cause a corresponding displacement of lever 138 without a change in the length of spring portion 142 under normal operating conditions. Movement of lever 138 sets the desired engine speed and, as the load on engine 24 changes, the governor of engine 24 adjusts the throttle plate of the carburetor to maintain the engine speed selected by the positioning of lever 138.

Figure 2:
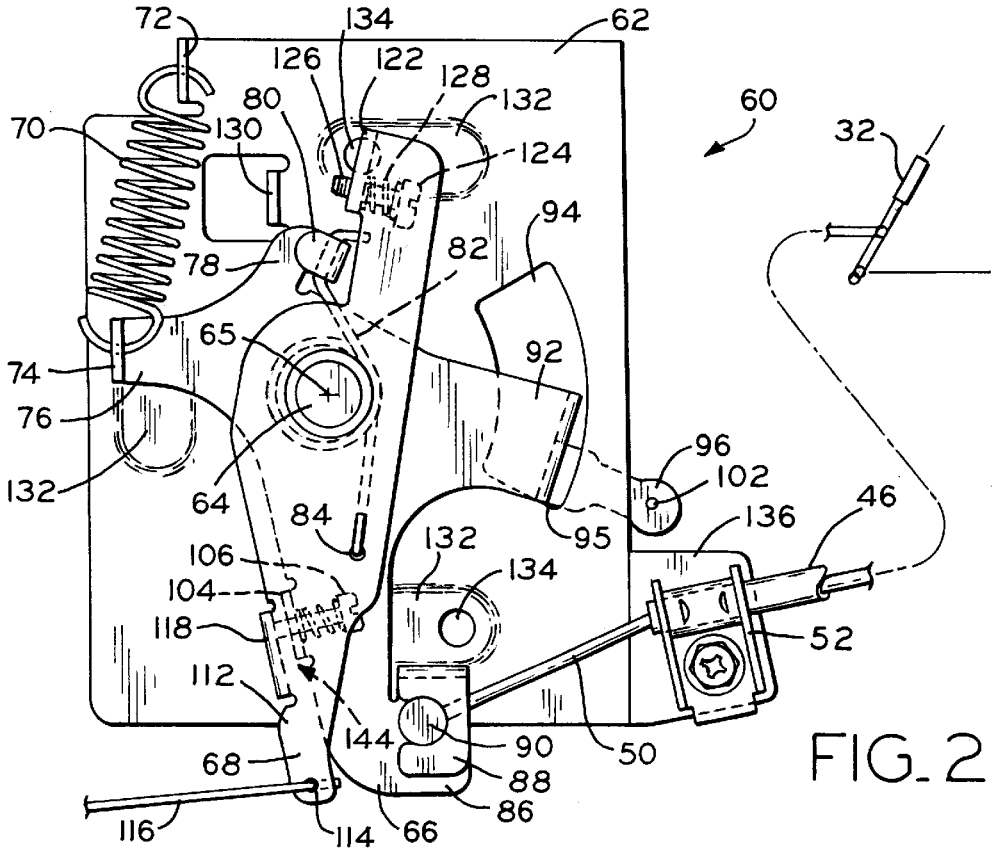
FIG. 2 is a view of a linkage assembly in an idle position and a schematic view of the accelerator.

The operation of linkage assembly 60 will now be discussed. When no pressure is applied to accelerator 32, spring 70 biases first linkage body 66 into the position shown in FIG. 2. Spring 70 biases first linkage body 66 in a pivotal direction about axis 65 defined by rivet 64 which, when viewing FIG. 2, is a clockwise direction. Movement of first linkage body 66 in the first pivotal direction is limited by arm 92 contacting side edge 95 of opening 94 in base plate 62. When viewing assembly 60 as shown in FIG. 2, torsion spring 82 biases second linkage body 68 relative to first linkage body 66 pivotally about axis 65 in a counterclockwise direction. The movement of second linkage body 68 in a counterclockwise direction is limited by the engagement of stop tab 118 with the distal end of bolt 106. When engine 24 is idling normally, linkage assembly 60 will be in the position shown in FIG. 2.

Movement of accelerator 32 by the operator of vehicle 20 determines the position of linkage assembly 60 and FIG. 2 also schematically illustrates the position of accelerator 32 in the idle position. Spring or biasing member 70 will return linkage assembly 60 and accelerator 32 to their idle positions in the absence of any pressure on accelerator 32 by the operator.

As best seen in FIG. 7, which illustrates linkage assembly 60 in the same idle position as shown in FIG. 2, the position of second linkage body 68 determines the position of governor lever 138 via governor spring 116. In the illustrated embodiment, governor lever 138 is rotated about point 139, when viewed as shown in FIG. 7, in a counterclockwise direction to increase the engine speed and in a clockwise direction to decrease the engine speed. Thus, in the illustrated embodiment, counterclockwise movement of second linkage body 68 moves lever 138 in a direction which results in an increase in the engine speed and clockwise movement of second linkage body 68 moves lever 138 in a direction which results in a decrease in the engine speed.

In the idle position, the position of first linkage 66 is determined by engagement of arm 92 with edge 95, thus, adjustment of bolt 106 will adjust the relative positions of first and second linkage bodies 66, 68, and thereby also adjust the position of second linkage body 68 relative to lever 138 and the idle speed of engine 24. In the illustrated embodiment, the idle speed of engine 24 may be set at approximately 2100 rpm.

With engine 24 running and linkage assembly 60 in the idle position shown in FIG. 2, movement of second linkage body 68 in the direction which corresponds to an increase in engine speed is prevented by the engagement of stop 118 and bolt 106. Although spring portion 142 may allow for some relative movement between lever 138 and second linkage body 68 resulting in an increase of the engine speed during idling, such movement and resulting increase in speed would be relatively minor. The limiting of the engine speed during idling by linkage assembly 60 as described above is advantageous in small recreational vehicles such as vehicle 20 which include a centrifugal clutch because it allows the idle speed of engine 24 to be set in a manner which prevents the clutch from engaging when the operator of vehicle 20 removes his/her foot from accelerator 32 such as during braking operations or when leaving vehicle 20 unattended and when the engagement of the clutch is undesirable. Movement of second linkage body 68 in the opposite direction corresponding to a decrease in engine speed is inhibited by torsion spring 82 which is sufficiently stiff to resist such movement under normal operating conditions.

Figure 3:
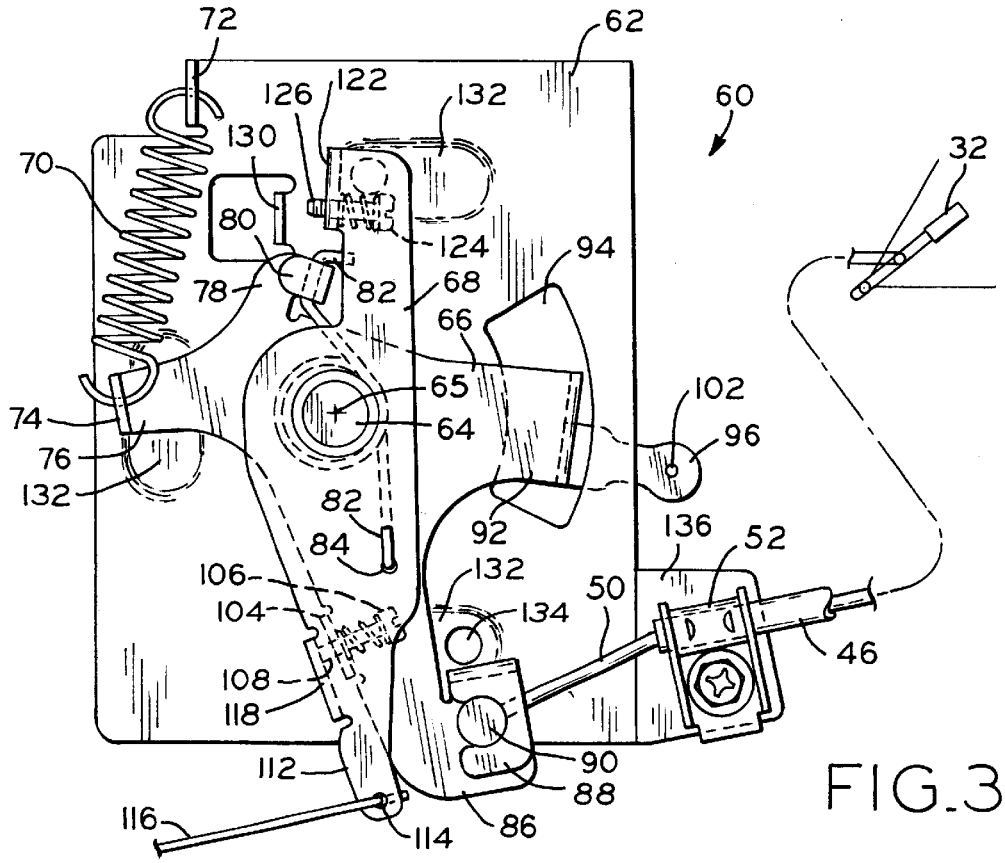
FIG. 3 is a view of the linkage assembly of FIG. 2 with both the first and second linkage bodies in an intermediate position and a schematic view of the accelerator.

FIG. 3 illustrates linkage assembly 60 when the operator has partially depressed accelerator 32. In this condition, partial depression of accelerator 32 pulls rod 36 forward which, in turn, pulls cable 50 resulting in bobbin 90 being pulled toward clamp 52 and the movement of first linkage body 66 in a counterclockwise direction about axis 65. As first linkage body 66 rotates about axis 65, torsion spring 82 continues to bias second linkage body 68 into contact with first linkage body 66, i.e., engagement of stop 118 with bolt 106. As second linkage body 68 moves along with first linkage body 66, governor spring 116 moves governor lever 138 resulting in an increase in the engine speed. As the engine speed increases, the centrifugal clutch engages, driving rear wheels 28 and moving vehicle 20 forward. As accelerator 32 is depressed further by the operator, first linkage body 66 continues to be rotated in a counterclockwise direction resulting in the further movement second linkage body 68 and further increases in the speed of engine 24 and corresponding increases in the ground speed of vehicle 20. Spring 70 resists the rotation of first linkage body 66 in the counterclockwise direction and, thus, provides some resistance to the depression of accelerator 32 by the operator.

Figure 4:
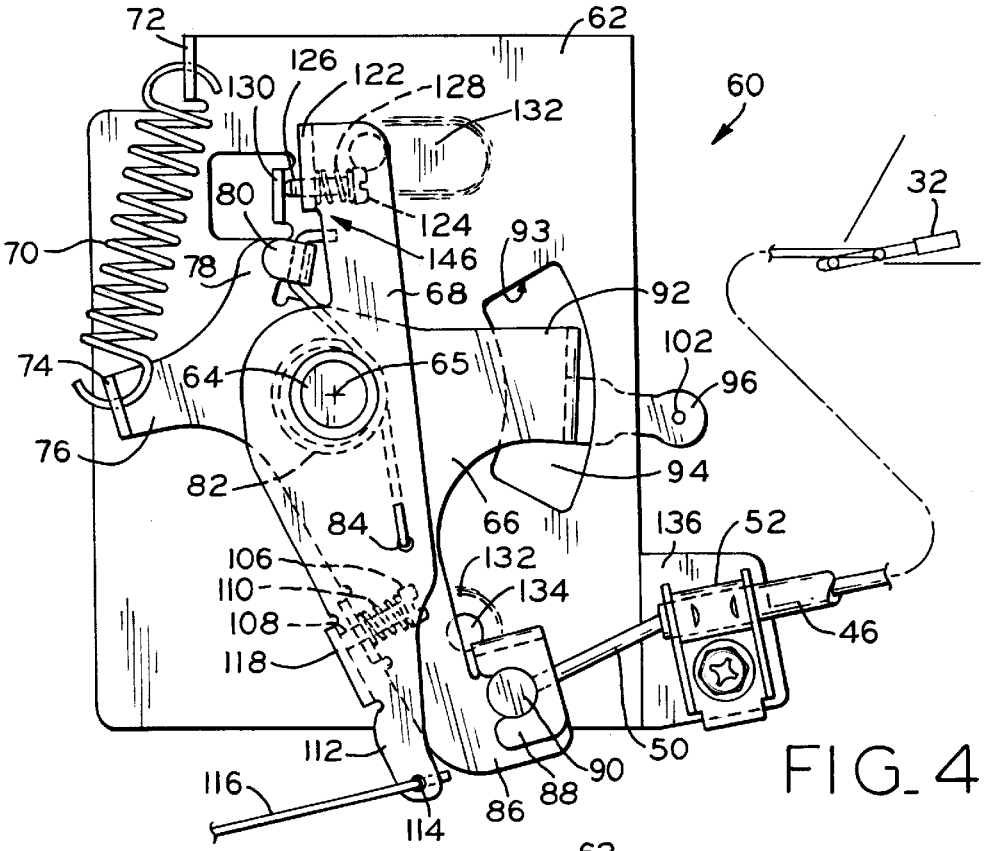
FIG. 4 is a view of the linkage assembly of FIG. 2 with the first linkage body in an intermediate position and the second linkage body in its maximum position and a schematic view of the accelerator.

After further depression of accelerator 32, linkage assembly reaches the position shown in FIG. 4. In this position, the distal end of bolt 124 has contacted stop 130 whereby further movement of second linkage body 68 in a counterclockwise direction about axis 65 is prevented. This position defines the maximum extent to which second linkage body 68 may move lever 138 to increase the speed of engine 24. By adjusting bolt 124 the position of second linkage body 68 when bolt 124 engages stop 130 may be altered to thereby adjust the maximum engine speed obtainable by the operator by depressing accelerator 32. In the illustrated embodiment, the maximum engine speed may be set at approximately 3600 rpm. The engagement of bolt 124 with stop 130, however, does not prevent the further depression of accelerator 32 as explained with reference to FIG. 5.

Figure 5:
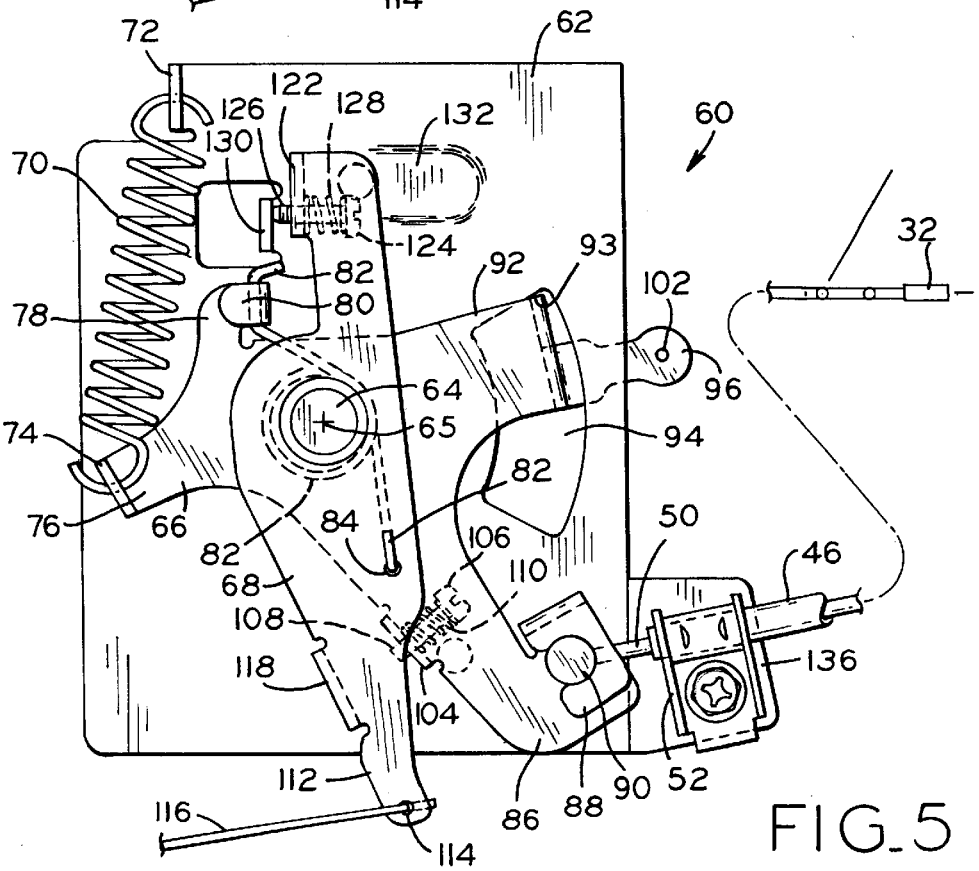
FIG. 5 is a view of the linkage assembly of FIG. 2 with both the first and second linkage bodies in maximum positions and a schematic view of the accelerator.
Figure 6:
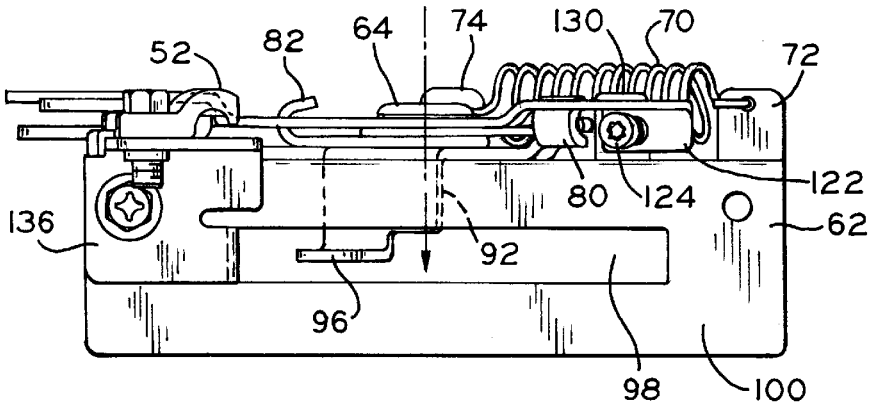
FIG. 6 is a side view of the linkage assembly of FIG. 2.

FIG. 5 illustrates linkage assembly 60 in a position after accelerator 32 has been depressed beyond the point illustrated in FIG. 4 and represents assembly 60 when accelerator 32 is in a position which does not allow further depression of accelerator 32. As accelerator 32 is depressed beyond the point resulting in the configuration of FIG. 4, first linkage body 66 continues to rotate in a counterclockwise direction until arm 92 contacts edge 93 of opening 94 which thereby limits the further rotation of first linkage body 66 and, consequently, also limits the further depression of accelerator 32. Alternatively, the maximum extent to which accelerator 32 could be depressed could correspond to the bottoming out of accelerator 32 on the floor or other structure of vehicle 20 at a point before arm 92 contacts edge 93. As accelerator 32 is depressed to move first linkage body 66 between the positions shown in FIGS. 4 and 5, second linkage body 68 remains stationary relative to governor lever 138 and first linkage body 66 is rotated relative to second linkage body 68. As first and second linkage bodies 66 and 68 move relative to each other, the biasing force of torsion spring 82 is overcome and bolt 106 is moved out of engagement with stop 118 as can be seen in FIG. 5. Since second linkage body 68 does not move relative to lever 138, the further depression of accelerator to accomplish the movement of first linkage body from the position shown in FIG. 4 to that shown in FIG. 5 does not result in an increase in the engine speed. The operator of vehicle 20, however, continues to feel the resistance to the depression of accelerator 32 created by spring 70, as well as that contributed by torsion spring 82, during this movement which occurs between the positions illustrated in FIGS. 4 and 5.

As the operator allows accelerator 32 to return to the idle position, linkage assembly 60 returns to the position shown in FIG. 2 due to the biasing actions of springs 70 and 82 assuming the same configurations discussed above.

As can be seen in FIGS. 2–5, accelerator 32 has a first range of motion ranging from an input idle position, shown in FIG. 2, to an input maximum position, shown in FIG. 5. As accelerator 32 is moved through this range of motion, rod 36 and cable 46 transfer this motion to first linkage body 66 which is correspondingly moved from a first linkage idle position, shown in FIG. 2, to a first linkage maximum position, shown in FIG. 5. Second linkage body 68 defines a third range of motion which includes a second linkage idle position, shown in FIG. 2, and a second linkage maximum throttle position, shown in FIGS. 4 and 5.

Although the illustrated embodiment shows first and second linkage bodies 66 and 68 which are pivotally mounted, and pivot in a particular direction, alternative embodiments could pivot in the opposite directions. The linkage assembly might also use an alternative configuration of linkage bodies which utilize linear or arcuate sliding motions to provide the same relative motions between accelerator 32, first linkage body 66, second linkage body 68 and governor lever 138.

While this invention has been described as having an exemplary design, the present invention may be further modified within the spirit and scope of this disclosure. This application is therefore intended to cover any variations, uses, or adaptations of the invention using its general principles.

What is claimed is:

1. A vehicle comprising:

a vehicle body;

an engine mounted on said vehicle body;

a user-operable speed control assembly operably coupled to said engine wherein said speed control assembly selectively varies the speed of said engine, said speed control assembly comprising:

a user-operable input mechanism having a first range of motion ranging from an input idle position to an input maximum position;

a first linkage body operably coupled with said input mechanism and having a second range of motion ranging from a first linkage idle position to a first linkage maximum position wherein movement of said input mechanism from said input idle position through said input maximum position correspondingly moves said first linkage body through said second range of motion from said first linkage idle position to said first linkage maximum position;

a first biasing member operably coupled to said speed control assembly for biasing said first linkage body and said user-operable input mechanism toward said first linkage idle position and said input idle position respectively;

a second linkage body having a third range of motion which includes a second linkage idle position and a second linkage maximum throttle position, said second linkage body operably coupled to said engine wherein movement of said second linkage body through said third range of motion varies the speed of said engine, movement of said second linkage member in a first direction from said second linkage idle position toward said second linkage maximum throttle position progressively increasing the speed of said engine, said second linkage body being movable relative to said first linkage body, a second biasing member biasing said second linkage body relative to said first linkage body in said first direction, said second linkage body engagable with said first linkage body whereby relative movement of said second linkage body relative to said first linkage body in said first direction is limited, and wherein, as said first linkage body is moved through said second range of motion from said first linkage idle position to said first linkage maximum position, said second linkage body remains engaged with said first linkage body and is moved in said first direction until said second linkage member engages a stop which limits further travel of said second linkage member in said first direction, said first linkage body being intermediate said first linkage idle and said first linkage maximum positions when said second linkage body engages said stop, further travel of said first linkage body toward said first linkage maximum position after said second linkage body has engaged said stop causing relative movement of said first and second linkage bodies in a direction opposed by said second biasing element.

2. The vehicle of claim 1 further comprising a first adjustable stop mechanism operably disposed between said first linkage body and said second linkage body, said first stop mechanism selectively adjusting the relative positions of said first and second linkage bodies when said second linkage body is engaged with said first linkage body.

3. The vehicle of claim 2 further comprising a second adjustable stop mechanism operably disposed between said second linkage body and said vehicle body, said second stop mechanism including said stop and selectively adjusting the extent to which said second linkage body can travel in said first direction.

4. The vehicle of claim 1 further comprising an adjustable stop mechanism operably disposed between said second linkage body and said vehicle body, said second stop mechanism including said stop and selectively adjusting the extent to which said second linkage body can travel in said first direction.

5. The vehicle of claim 1 wherein said first and second linkage bodies are pivotally mounted about a common pivot axis.

6. The vehicle of claim 1 wherein said first biasing member is secured to said first linkage body.

7. A vehicle comprising:

a vehicle body;

an engine mounted on said vehicle body, said engine having a governor lever coupled thereto, movement of said governor lever adjusting the speed of said engine;

a user-operated input mechanism having a first range of motion ranging from an input idle position to an input maximum position, a first linkage body operably coupled to said input mechanism, said first linkage body having a second range of motion ranging from a first linkage idle position to a first linkage maximum position;

a first biasing member operably coupled to said first linkage body and biasing said first linkage body toward said first linkage idle position;

a second linkage body, said second linkage body moveable through a third range of motion including a first position and a second position, said second linkage body operably coupled to said governor lever, movement of said second linkage body in a first direction from said first position to said second position progressively moving said governor lever in a direction causing an increase in the speed of said engine;

a second biasing member, said second linkage body movable relative to and engageable with said first linkage body, said second biasing member biasing said second linkage body relative to said first linkage body in said first direction and toward engagement with said first linkage body;

a first adjustable stop mechanism, said first stop mechanism selectively adjusting the relative positions of said first and second linkage bodies when said second biasing member biases said first and second linkage bodies into engagement, said first and second linkage bodies being engagable when said first linkage body is in said first linkage idle position;

a second adjustable stop mechanism wherein movement of said first linkage mechanism from said first linkage idle position toward said first linkage maximum position engages said second linkage body with at least a portion of said second stop mechanism, said second stop mechanism selectively adjusting the relative positions of said second linkage body and said governor lever when said second linkage body engages said portion of said second stop mechanism, said first linkage member movable relative to said second linkage member to said first linkage maximum position with said second linkage body engaged with said portion of said second stop mechanism.

8. The vehicle of claim 7 wherein at least one of said first and second stop mechanisms includes a threadingly adjustable member.

9. The vehicle of claim 7 wherein said first and second linkage bodies are pivotally mounted about a common pivot axis.

10. The vehicle of claim 7 wherein said operable coupling of said input mechanism and said first linkage body includes a cable secured to said first linkage body.

11. A linkage assembly for a vehicle having an engine and an operator-controlled speed control input mechanism, said linkage assembly comprising:

a mounting member securable to the vehicle;

a first linkage body pivotally secured to said mounting member, said first linkage body is movable relative to said mounting member in a range of motion extending from an idle position to a maximum position, movement from said idle position toward said maximum position defining a first pivotal direction, said first linkage body adapted for operable coupling with the user-controlled input mechanism wherein the user-controlled input mechanism controls movement of said first linkage body through said range of motion;

a first biasing member operably disposed between said first linkage body and said mounting member for biasing said first linkage body with respect to said mounting member in a second pivotal direction opposite said first direction;

a second linkage body pivotally secured to said mounting member; each of said first and second linkage bodies pivotal about a common axis, said second linkage body adapted for operable coupling with the engine wherein movement of said second linkage body selectively adjusts the speed of the engine with movement of said second linkage body in said first pivotal direction progressively increasing the speed of the engine;

a second biasing member operably disposed between said first and second linkage bodies, said second biasing member biasing said second linkage body relative to said first linkage body in said first direction;

a first adjustable stop mechanism operably disposed between said first and second linkage bodies wherein movement of said second linkage body in said first direction relative to said first linkage body is limited by said first stop mechanism, relative positions of said first and second linkage bodies when said first and second linkage bodies are engaged being selectively adjustable by said first stop mechanism;

a second adjustable stop mechanism operably disposed between said mounting member and said second linkage member wherein movement of said second linkage body in said first direction relative to said mounting member is limited by said second stop mechanism, relative positions of said mounting member and said second linkage body when said second stop mechanism has limited travel of said second linkage body being selectively adjustable by said second stop mechanism; and wherein as said first linkage body moves from said idle position toward said maximum position, said second linkage body remains in said relative position defined by said first stop mechanism and is moved in said first direction until said second adjustable stop mechanism limits further travel of said second linkage member in said first direction, said first linkage body being intermediate said idle position and said maximum position when movement said second linkage body is limited by said second stop mechanism, further travel of said first linkage body toward said maximum position after said second stop mechanism has limited further movement of said second linkage body causing relative movement of said first and second linkage bodies in a direction opposed by said second biasing member.

12. The linkage assembly of claim 11 wherein said first and second stop mechanisms each include a threadingly adjustable member.

13. The linkage assembly of claim 11 wherein each of said first and second linkage bodies are secured to said mounting member with a common fastener, said fastener defining said common pivot axis.

14. The linkage assembly of claim 11 wherein said first stop mechanism comprises a first bent tab on said first linkage body, a second bent tab on said second linkage body and a threaded member secured in an opening in one of said bent tabs and engageable with the other of said bent tabs.

15. The linkage assembly of claim 11 wherein said second stop mechanism comprises a first bent tab on said mounting member, a second bent tab on said second linkage body and a threaded member secured in an opening in one of said bent tabs and engageable with the other of said bent tabs.

16. The linkage assembly of claim 11 wherein said first biasing member comprises a spring secured to said mounting member and said first linkage body.

17. A method of variably controlling the running speed of an engine, said method comprising:

providing a user-operable input mechanism moveable through a first range of motion between an input idle position and an input maximum position and a linkage assembly having a first linkage body and a second linkage body;

operably coupling said first linkage body to said input mechanism wherein said first linkage body is moved through a second range of motion from a first linkage idle position to a first linkage maximum position as said input mechanism is moved from said input idle position to said input maximum position;

operably coupling said second linkage body to the engine wherein the position of said second linkage body controls the running speed of the engine;

adjustably positioning said second linkage body in a second linkage idle position relative to said first linkage body when said first linkage body is disposed in said first linkage idle position wherein adjustment of said second linkage idle position adjusts the idle speed of the engine;

operably coupling said second linkage body to said first linkage body wherein said second linkage body is moved from said second linkage idle position to a second linkage maximum throttle position as said first linkage body is moved from said first linkage idle position toward said first linkage maximum position and wherein movement of said second linkage body from said second linkage idle position toward said second linkage maximum throttle position progressively increases the speed of the engine;

stopping movement of said second linkage body at a selectively adjustable position defining said second linkage maximum throttle position before said input mechanism has reached said input maximum position and wherein said input mechanism is moveable to said input maximum position after stopping movement of said second linkage body at said second linkage maximum throttle position.

18. The method of claim 17 wherein said first linkage body is moveable to said first linkage maximum position after stopping movement of said second linkage body at said second linkage maximum throttle position.

19. The method of claim 17 further comprising biasing said second linkage body toward said first linkage body in a direction toward said second linkage maximum throttle position.

20. The method of claim 17 further comprising biasing said input mechanism toward said input idle position.

21. A method of variably controlling the running speed of an engine, said method comprising:

providing a user-operable input mechanism moveable through a first range of motion between an input idle position and an input maximum position and a linkage assembly having a first linkage body and a second linkage body;

operably coupling said first linkage body to said input mechanism wherein said first linkage body is moved through a second range of motion from a first linkage idle position to a first linkage maximum position as said input mechanism is moved from said input idle position to said input maximum position;

operably coupling said second linkage body to the engine wherein the position of said second linkage body controls the running speed of the engine;

operably coupling said second linkage body to said first linkage body including (a) disposing said second linkage body in a selectively adjustable position relative to said first linkage body when said first linkage body is disposed in said first linkage idle position; (b) maintaining said second linkage body in the selected position relative to said first linkage body and moving said second linkage body in a first direction progressively increasing the speed of the engine as said first linkage is moved from said first linkage idle position toward said first linkage maximum position; and (c) stopping movement of said second linkage body in the first direction at a selectively adjustable location wherein said first linkage body is moveable relative to said second linkage body and to said first linkage maximum position after stopping movement of said second linkage body.

22. The method of claim 21 wherein maintaining said second linkage body in the selected position relative to said first linkage body includes biasing said second linkage body toward said first linkage body in said first direction.

23. The method of claim 21 further comprising biasing said first linkage body toward said first linkage idle position.

* * * * *